US008327945B2

(12) United States Patent
Gette et al.

(10) Patent No.: US 8,327,945 B2
(45) Date of Patent: Dec. 11, 2012

(54) REMOTELY OPERATED DRILL PIPE VALVE

(75) Inventors: Nicholas P. Gette, Houston, TX (US); Gregory M. Dunn, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 689 days.

(21) Appl. No.: 12/433,628

(22) Filed: Apr. 30, 2009

(65) Prior Publication Data

US 2010/0276153 A1 Nov. 4, 2010

(51) Int. Cl.
*E21B 34/14* (2006.01)
*E21B 33/12* (2006.01)
*E21B 23/00* (2006.01)

(52) U.S. Cl. ..... 166/381; 166/330; 166/120; 166/319

(58) Field of Classification Search ..... 166/336, 166/341, 343, 348, 123, 182, 209, 351, 330, 166/120, 319

See application file for complete search history.

(56) References Cited

U.S. PATENT DOCUMENTS

| | | | | |
|---|---|---|---|---|
| 3,194,325 | A * | 7/1965 | Gianelloni, Jr. | 175/26 |
| 6,516,876 | B1 | 2/2003 | Jennings | |
| 6,719,044 | B2 | 4/2004 | Ford et al. | |
| 6,823,938 | B1 | 11/2004 | Milberger | |
| 6,848,511 | B1 | 2/2005 | Jones et al. | |
| 7,231,970 | B2 | 6/2007 | Matusek et al. | |
| 7,407,011 | B2 | 8/2008 | Kent | |

* cited by examiner

*Primary Examiner* — Thomas Beach
*Assistant Examiner* — James Sayre
(74) *Attorney, Agent, or Firm* — Bracewell & Giuliani LLP

(57) ABSTRACT

A valve, such as a ball valve, is assembled and carried by a running tool. The valve is actuated by an actuator that is triggered by the running tool, and thus opens and closes communication between the drill pipe and the volume below the running tool. An actuating cam is assembled below the running tool that interfaces the actuator. The actuating cam is threaded such that it travels axially as the drill pipe is turned. A profile on the actuating cam is timed with the function of the running tool and controls the action of the actuator such that the valve is open when the running tool function requires communication with the volume below the running tool and the valve is closed when the running tool needs to be pressurized.

20 Claims, 8 Drawing Sheets

REMOTELY OPERATED DRILL PIPE VALVE

FIELD OF THE INVENTION

This invention relates in general to subsea tools and in particular to a remotely operated drill pipe valve.

BACKGROUND OF THE INVENTION

A subsea well of the type concerned herein will have a wellhead supported on the subsea floor. One or more strings of casing will be lowered into the wellhead from the surface, each supported on a casing hanger. The casing hanger is a tubular member that is secured to the threaded upper end of the string of casing. The casing hanger lands on a landing shoulder in the wellhead, or on a previously installed casing hanger having larger diameter casing. Cement is pumped down the string of casing to flow back up the annulus around the string of casing. Afterward, a packoff is positioned between the wellhead bore and an upper portion of the casing hanger. This seals the casing hanger annulus.

One type of packoff utilizes a metal seal so as to avoid deterioration with time that may occur with elastomeric seals. Metal seals require a much higher force to set than elastomeric seals. Prior art running tools have employed various means to apply the downward force needed to set a packoff. Some prior art tools use rotation of the drill string to apply setting torque. It is difficult to achieve sufficient torque to generate the necessary forces for a metal packoff, because the running tool may be located more than a thousand feet below the water surface in deep water.

Other running tools and techniques shown in the patented art apply pressure to the annulus below the blowout preventer and the running tool. If the blowout preventer is at the surface, the amount of annulus pressure is limited, however, to the pressure rating of the riser through which the drill string extends. This pressure rating is normally not enough to set a metal packoff.

Higher pressure can be achieved by pumping through the drill string. However, this requires a running tool with some type of ports that are opened and closed from the surface. This is necessary because cement must first be pumped down the drill string. The ports may be open and closed by dropping a ball or dart. A considerable amount of time, however, is required for the ball to reach the seat. Rig time is quite expensive. Another method employs raising and lowering the drill pipe and rotating in various manners to engage and disengage J-slots to open and close ports. This has a disadvantage of the pins for the J-slots wearing and not engaging properly.

As previously indicated, often times a portion of drill pipe must be sealed in order to pressurize the volume of pipe above the seal. In many instances an object such as a ball, a dart, or a plug, is dropped down the drill pipe to create a seal which isolates the area above the object, allowing it to be pressurized. In order to create a seal, there must be a surface within the drill pipe for the object to land on and seal against. The seal is then deactivated by over-pressurizing, which can burst a rupture disc, break shear pins, or extrude metal. Alternatively, the object can be retrieved on a wire line. In other instances, a plug may be preinstalled prior to running the tool. However, in this instance, once the drill pipe has been pressurized, the plug must be deactivated as previously discussed. The dropping and retrieval of the sealing object is time consuming and often proves to be unreliable and inconsistent.

A need exists for a technique that addresses the effective and efficient activation and deactivation of a seal for isolating and pressurizing a section of drill pipe. The following technique may solve one or more of these problems.

SUMMARY OF THE INVENTION

In an embodiment of the present technique, a valve, such as a ball valve is assembled and carried by a running tool. The valve is actuated by an actuator that is triggered by the running tool, and thus opens and closes communication between the drill pipe and the volume below the running tool depending upon the position of the actuator. An actuating cam is assembled below the running tool and interfaces the actuator. The actuating cam is threaded such that it travels axially relative to the stem as the stem is rotated. A profile on the actuating cam is timed with the function of the running tool and controls the action of the actuator such that the valve is open when the running tool function requires communication with the volume below the running tool and closed when the running tool needs to be pressurized.

In an alternate embodiment of the present technique, a valve, such as a ball valve is assembled and carried by a running tool. The valve is actuated by an actuator that is triggered by the running tool, and thus opens and closes communication between the drill pipe and the volume below the running tool. An actuating cam is assembled as part of the running tool and interfaces the actuator. The actuating cam is connected to the running tool body and is free to rotate but does not move axially. The running tool stem is threaded to the body such that it travels axially relative to the body as the stem is rotated. A profile on the actuating cam is timed with the function of the running tool and controls the action of the actuator such that the valve is open when the running tool function requires communication with the volume below the running tool and closed when the running tool needs to be pressurized.

DETAILED DESCRIPTION OF THE INVENTION

Figure 1:
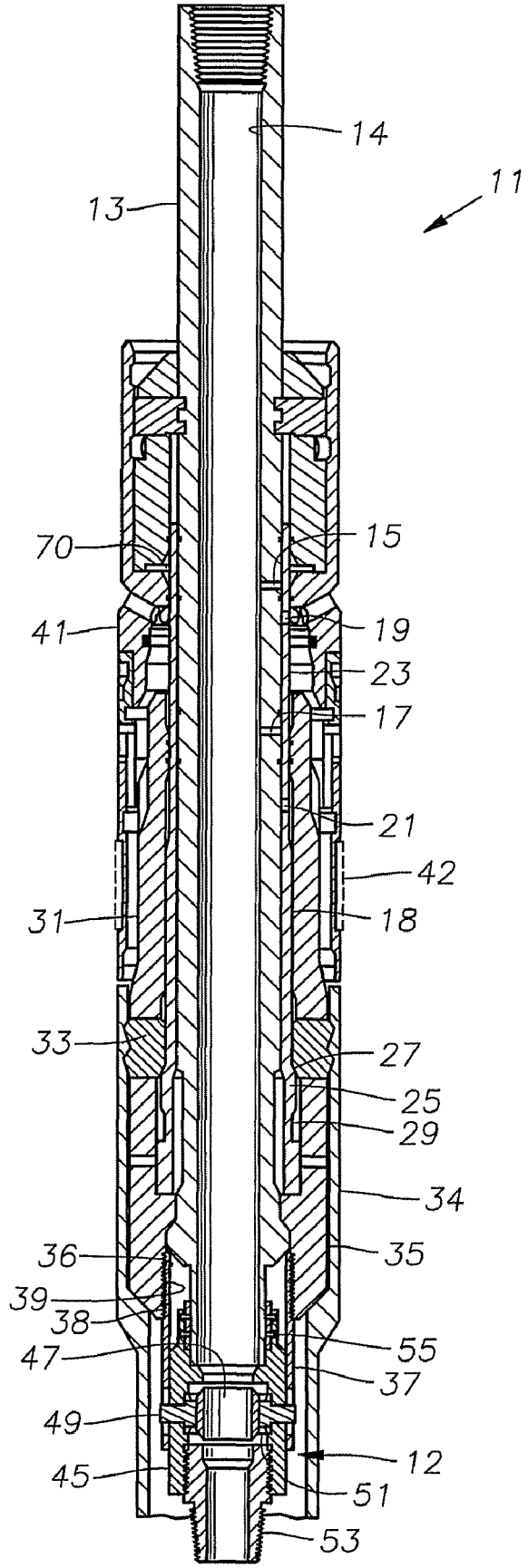
FIG. 1 is a sectional view of a running tool with a valve assembly constructed in accordance with the present technique.

Referring to FIG. 1, there is generally shown an embodiment for a running tool 11 that is used to remotely operate a drill pipe valve assembly 12 in conjunction with setting and internally testing a casing hanger packoff. In this particular embodiment, running tool 11 is a two-port casing hanger running tool. However, remotely operated drill pipe valve assembly 12 is not limited to this embodiment and may be employed with other running tool designs such as single or no port running tools. The running tool 11 is comprised of a stem 13. Stem 13 is a tubular member with an axial passage 14 extending therethrough. Stem 13 connects on its upper end to a string of drill pipe (not shown) and the drill pipe valve assembly 12 at the lower end. Stem 13 has an upper stem port 15 and a lower stem port 17 positioned in and extending therethrough that allow fluid communication between the exterior and axial passage 14 of the stem 13.

An inner cam 18 is a sleeve connected to and substantially surrounding stem 13. In this embodiment, inner cam 18 has axially extending slots (not shown) along portions of its inner diameter. Keys (not shown) extend radially from outer diameter portions of the stem 13 and are captured in the axially extending slots (not shown) on the inner diameter portions of the inner cam 18, such that the stem 13 and the inner cam 18 rotate in unison. The axially extending slots (not shown) allow the inner cam 18 to move axially relative to the stem 13. Portions of the outer diameter of the inner cam 18 have threads (not shown) contained therein. Inner cam 18 has an upper inner cam port 19 and a lower inner cam port 21 positioned in and extending therethrough that allow fluid communication between the exterior and interior of the inner cam 18. The inner cam 18 has an upper cam portion 23 and a lower cam portion 25. The lower cam portion 25 has a generally uniform outer diameter, except for an upwardly facing annular shoulder 27 on the outer surface of inner cam 18. A recessed pocket 29 is positioned in the outer surface of the inner cam 18 at a select distance below the upwardly facing shoulder 27.

A body 31 substantially surrounds portions of inner cam 18 and tool stem 13. In this embodiment, the body 31 has threads (not shown) along portions of the inner diameter of the body 31 that threadably engage the threads (not shown) on portions of the outer diameter of the inner cam 18, such that the inner cam 18 can rotate relative to the body 31. A lower portion of body 31 houses an engaging element 33. In this particular embodiment, engaging element 33 is a plurality of dogs, each having a smooth inner surface and a contoured outer surface. The contoured outer surface of the engaging element 33 is adapted to engage a complimentary contoured surface on the inner surface of a casing hanger 34 when the engagement element 33 is engaged with the casing hanger 34. The inner surface of the engaging element 33 is initially in contact with an outer surface portion of the inner cam 18.

The body 31, cam 18, and stem 13 are connected in such a manner that rotation of the stem 13 in a first direction relative to body 31 causes the inner cam 18 to rotate in unison and simultaneously move axially upward relative to body 31. A bearing cap 35 is securely connected to a lower portion of body 31 and substantially surrounds portions of inner cam 18 and stem 13. The bearing cap 35 is an integral part of body 31 and as such, stem 13 also rotates relative to bearing cap 35. Portions of the inner diameter of the bearing cap 35 have threads 36 contained therein. An actuating sleeve or cam 37 is connected to the lower end of the bearing cap. In this embodiment, portions of the outer diameter of the actuating cam 37 have threads 38 contained therein. Threads 36 in the inner diameter of bearing cap 35 are in engagement with threads 38 on the outer diameter of the actuating cam 37. When actuating cam 37 is rotated relative to bearing cap 35, cam 37 moves axially relative to bearing cap because of threads 36, 38.

A piston 41 surrounds the stem 13 and substantial portions of the inner cam 18 and body 31. Piston 41 is an exterior sleeve and is initially in a "cocked" position relative to stem 13 as shown in FIG. 1. Piston 41 is connected and rotates in unison with stem 13 and is also capable of movement axially relative to stem 13. A casing hanger packoff seal 42 is carried by the piston 41 and is positioned along the lower end portion of piston 41. Packoff seal 42 will act to seal the casing hanger 34 to the wellhead housing when properly set.

Figure 2:
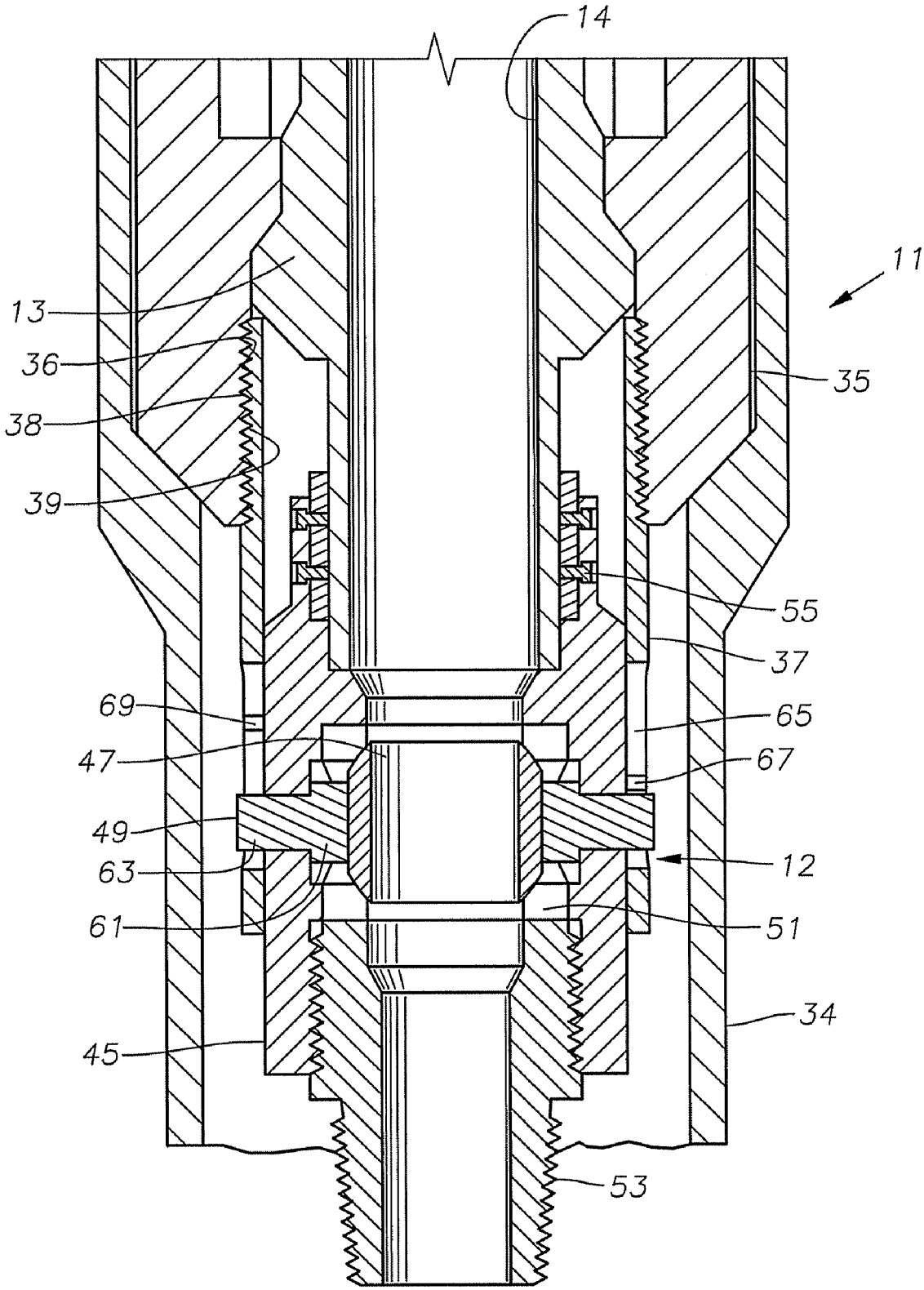
FIG. 2 is an enlarged sectional view of a portion of FIG. 1.

Referring to FIGS. 1 and 2, the valve assembly is comprised of valve body 45, ball valve element 47, valve actuator 49, valve seal 51, and universal threaded connector 53. Connector 53 may, for example, connect to a cement tool. In this particular embodiment, valve body 45 is securely connected to the lower end of stem 13 by anti-rotation keys 55 that ensure that stem 13 and valve body 45 rotate in unison. Valve body 45 is not capable of axial movement relative to stem 13 in this particular embodiment.

Valve body 45 is also connected to actuating cam 37 for rotating actuating cam 37. Valve body 45 and actuating cam 37 are connected to one another by anti-rotation keys 57 (FIG. 4) that ensure that valve body 45 and actuating cam 37 rotate in unison. Anti-rotation keys 57 connecting the valve body 45 and actuating cam 37 are positioned in axially extending slots 59 (FIG. 4) located in the actuating cam 37, thereby allowing actuating cam 37 to move axially relative to stem 13 and valve body 45, as stem 13, valve body 45, and actuating cam 37 rotate relative to bearing cap 35. The valve body 45 houses ball valve element 47 and actuators 49.

Figure 3:
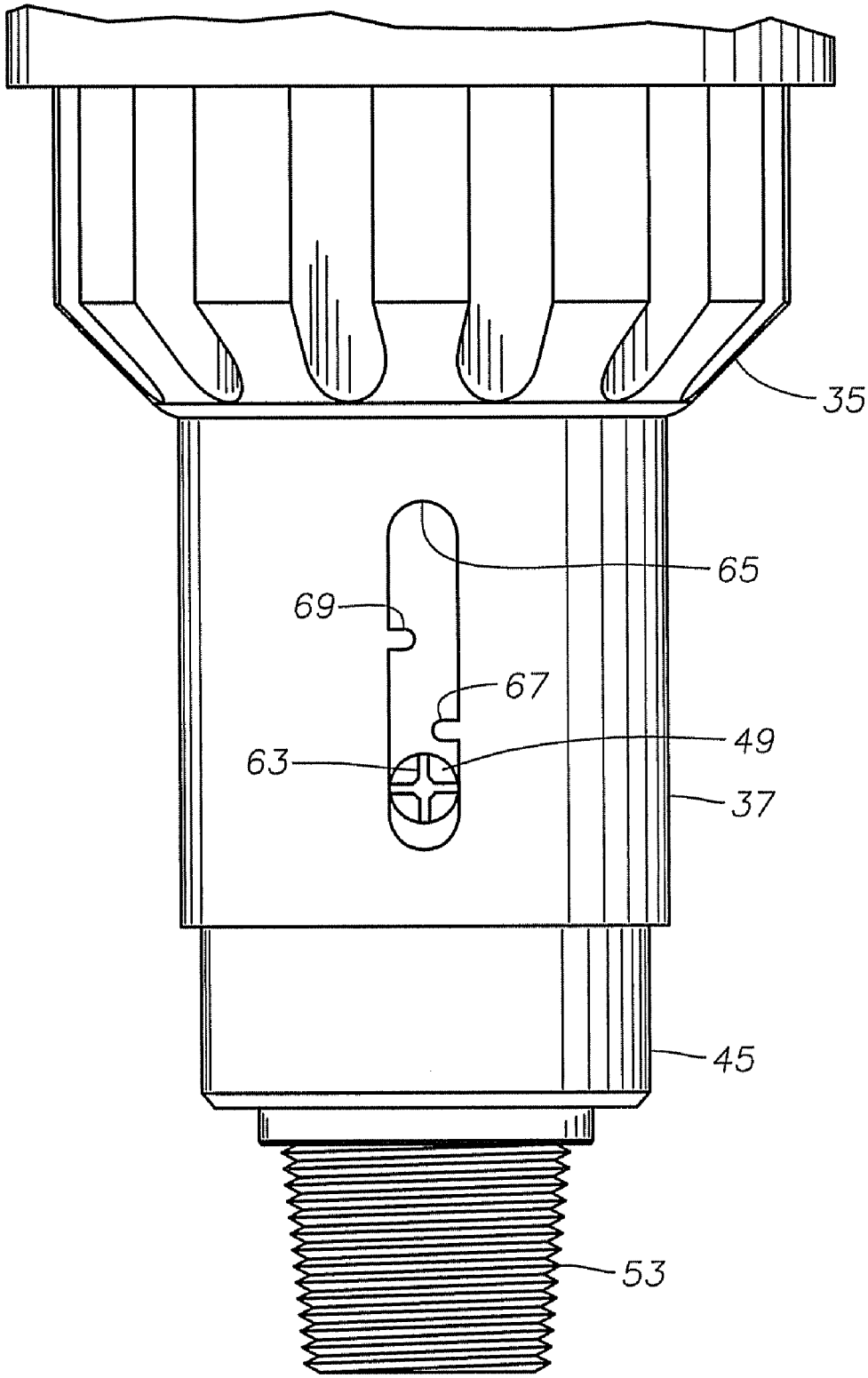
FIG. 3 is an isolated side view of the running tool of FIG. 1.
Figure 4:
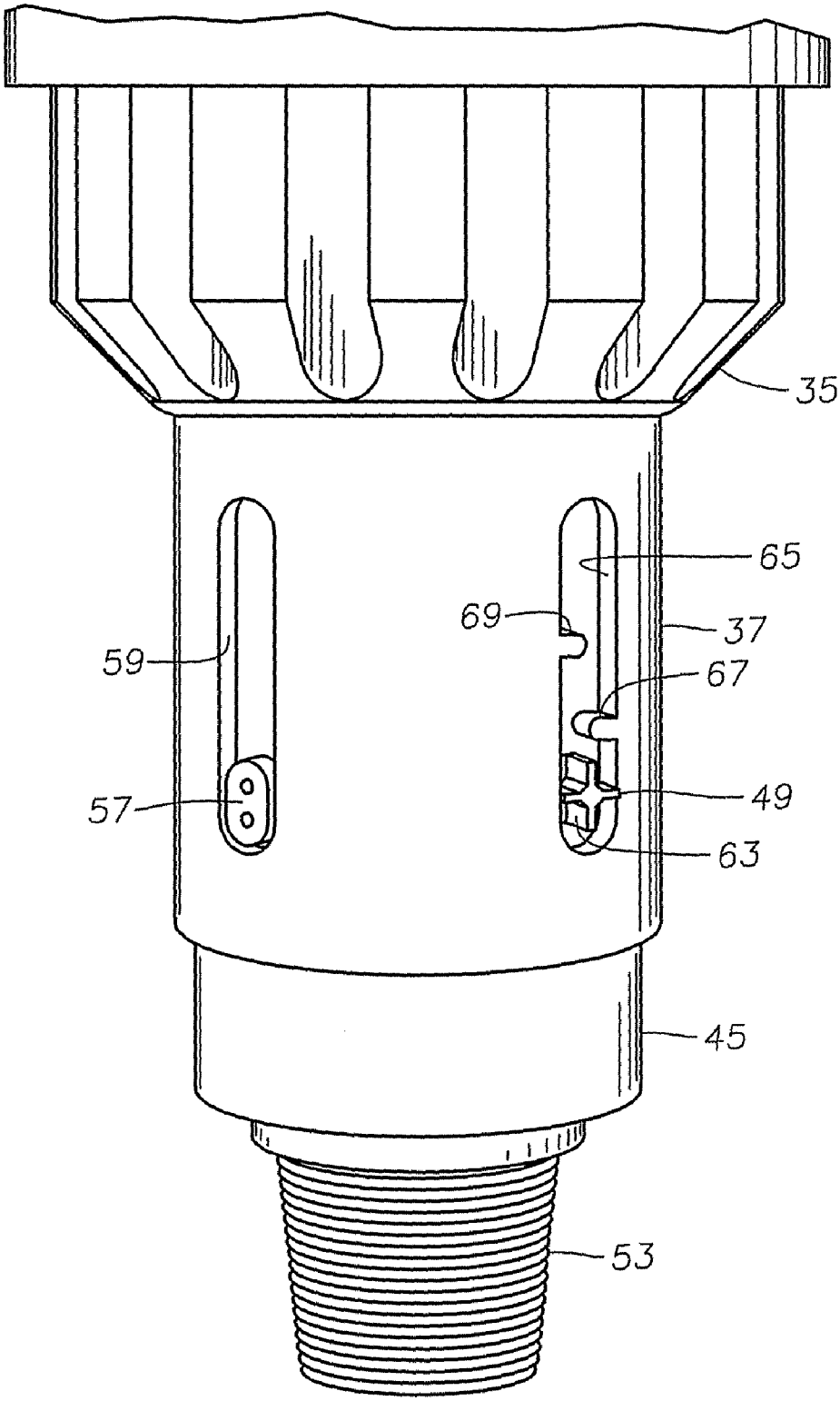
FIG. 4 is a perspective view of the running tool of FIG. 3.

Valve actuators 49 comprise axles or trunnions that extend radially outward from opposite sides of ball valve element 47. Valve actuators 49 are offset circumferentially from the anti-rotation keys 57 that connect the actuating cam 37 to the valve body 45. Referring to FIGS. 3 and 4, in this embodiment, each valve actuator 49 has a valve body portion 61 (FIG. 2) and a cam portion 63 that extends radially outward from opposite sides of the ball valve element 47. Cam portion 63 is cross-shaped when viewed in an end view having four slots ninety degrees apart from each other. A pair of elongated apertures 65 are located in and extend through opposite sides of actuating cam 37. Cam portions 63 extend outward from the valve body portions 61 (FIG. 2) of valve actuators 49 and extend through apertures 65 in actuating cam 37. Apertures 65 capture the cam portions 63. In this embodiment, actuators 49 are initially in a lower position within apertures 65, as illustrated in FIGS. 3 and 4. A set of tabs 67, 69 are formed in the outer peripheries of apertures 65 at different elevations from the end of apertures 65. The cam portions 63 are adapted to be rotated about their axes by contact with tabs 67, 69, thereby rotating valve actuators 49 and opening or closing ball valve element 47. One tab 67 is on one side edge of aperture 65 and tab 69 is on the other side edge.

In operation, the piston 41 is initially in a "cocked" position, and the stem ports 15, 17 and inner cam ports 19, 21 are offset from one another as shown in FIG. 1. A casing hanger packoff seal 42 is carried by the piston 41. The ball valve element 47 is initially in the open position to allow for through pipe operations such as cementing strings into place. In the open position, ball valve element 47 has the same diameter as passage 14 in stem 13. The running tool 11 is lowered into casing hanger 34 until the outer surface of the body 31 of running tool 11 slidingly engages the inner surface of the casing hanger 34. Casing hanger 34 will be secured to a string of casing that is supported by slips at the rig floor. Bearing cap 35 will be in contact with a shoulder or bowl in casing hanger 34.

Once the bearing cap 35 of running tool 11 and the casing hanger 34 are in abutting contact with one another, the stem 13 is rotated a specified number of revolutions relative to body 31 and bearing cap 35. Keys 55, 57 ensure that as stem 13 rotates, actuating cam 37, and valve body 45 rotate in unison and relative to bearing cap 35. As the stem 13 is rotated relative to the body 31 and bearing cap 35, the inner cam 18 and the actuating cam 37 move longitudinally in opposite directions relative to stem 13. As tool stem 13 and actuating cam 37 rotate, actuating cam 37, which is threaded to inner surface of bearing cap 35, begins to move axially downward relative to bearing cap 35 due to engagement of threads 36, 38. As the inner cam 18 moves longitudinally upward, the upwardly facing shoulder 27 on the outer surface of inner cam 18 makes contact with the engaging element 33, forcing it radially outward and in engaging contact with a profile or recess in the inner surface of the casing hanger 34, thereby locking body 31 to the casing hanger 34. As inner cam 18 moves longitudinally upward, stem ports 15, 17 and inner cam ports 19, 21 also move relative to one another.

Once the running tool 11 and the casing hanger 34 are locked to one another, the running tool 11 and the casing hanger 34 are lowered down the riser (not shown) until the casing hanger 34 comes to rest in a subsea wellhead housing. The operator then pumps cement down the string, through the casing and back up an annulus surrounding the casing. The operator then prepares to set the packoff seal 42.

In order to activate the piston 41 and set the packoff seal 42, ball valve element 47 must be closed. The stem 13 is then rotated a specified number of additional revolutions in the same direction as before. As the stem 13 is rotated relative to the body 31, the inner cam 18 and actuating cam 37 move further longitudinally relative to stem 13. As the inner cam 18 moves longitudinally upward, stem ports 15, 17 and inner cam ports 19, 21 also move relative to one another. Upper stem port 15 aligns with upper inner cam port 19, allowing fluid communication from the axial passage 14 of stem 13, through stem 13, into and through inner cam 18, and into chamber 70 of piston 41.

Figure 5:
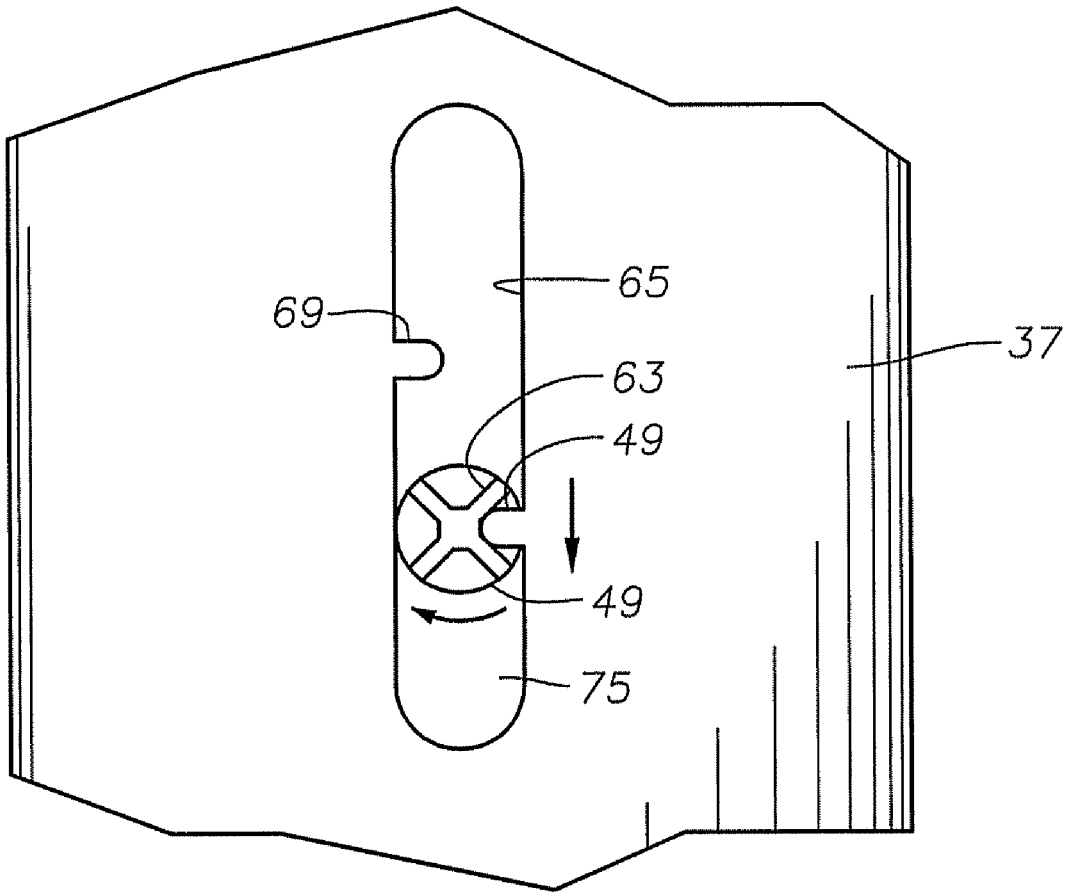
FIG. 5 is an isolated and enlarged view of the valve actuator as the valve is actuated.

Referring to FIG. 5, as the inner cam 18 (FIG. 1) moves longitudinally upward, the actuating cam 37 simultaneously rotates in unison with the stem 13 and also moves longitudinally downward because bearing cap 35 is held stationary with body 31. Stem 13 and valve body 45 do not move upward or downward during this rotation. The anti rotation keys 57 connecting the actuating cam 37 to the valve body 45 move longitudinally down in the slots 59 in actuating cam 37 as actuating cam 37 moves downward relative to valve body 45 as they both rotate. As stem 13 rotates, actuating cam 37 continues to move axially downward relative to valve body 45 and away from bearing cap 35. As actuating cam 37 moves axially downward, the position of cam portions 63 of valve actuators 49 change within slots 65. The stem 13, valve body 45, and actuating cam 37 continue to rotate, and actuating cam 37 moves axially downward relative to actuators 49 until tabs 67 make contact with the cam portions 63 of valve actuators 49, causing actuators 49 to rotate in a first direction as actuating cam 37 continues downward. As valve actuators 49 rotate, ball valve 47 simultaneously rotates to a closed position, thereby sealing the lower end of stem 13.

The operator stops rotating stem 13 at this point. Fluid pressure is then applied down the drill pipe and travels through the axial passage 14 of stem 13 before passing through upper stem port 15, upper inner cam port 19, and into chamber 70 of piston 41, driving it downward relative to the stem 13. As the piston 41 moves downward, the packoff seal 42 is set.

Once the piston 41 is driven downward and the packoff seal 42 is set, the stem 13 is then rotated an additional specified number of revolutions in the same direction as before. As the stem 13 is rotated relative to the body 31, the inner cam 18 and actuating cam 37 move further longitudinally in opposite directions relative to one another. As the inner cam 18 moves longitudinally upward, stem ports 15, 17 and inner cam ports 19, 21 also move relative to one another. Lower stem port 17 aligns with lower inner cam port 21, allowing fluid communication from the axial passage 14 of stem 13, through stem 13, into and through inner cam 18, and into an isolated volume above the packoff seal. Although the actuating cam 37 also continues to travel longitudinally downward, the ball valve element 47 remains closed because actuator 49 and cam portion 63 is still below tab 69. The operator stops rotating stem 13 for this test portion. Pressure is applied down the drill pipe and travels through the axial passage 14 of stem 13 before passing through lower stem port 17, lower inner cam port 21, and into an isolated volume above the packoff seal 42, thereby testing the packoff seal 42. A seal (not shown) on the outer diameter of the piston 41 seals against the bore of the wellhead housing (not shown) to define the test chamber.

Referring to FIG. 4, once the packoff seal has been tested, the stem 13 is then rotated a specified number of additional revolutions in the same direction. As the stem 13 is rotated relative to the body 31 and bearing cap 35, the inner cam 18 and the actuating cam 37 move further longitudinally apart from each other. As the inner cam 18 moves longitudinally upward, the engagement element 33 is freed and moves radially inward into recessed pocket 29 on the outer surface of inner cam 18, thereby unlocking the body 31 from the casing hanger 34. Because of threads 36, 38 the actuating cam 37 moves further longitudinally downward relative to the actuator 49 until upper tab 69 makes contact with the cam portions 63 of actuators 49. This engagement causes actuators 49 and the ball valve element 47 to rotate in a second direction, which is opposite from the earlier rotation, thereby opening the ball valve element 47. The open ball valve element 47 will vent the column of fluid in the drill pipe, allowing dry retrieval of the running tool 11. Running tool 11 can then be removed from the wellbore.

Figure 6:
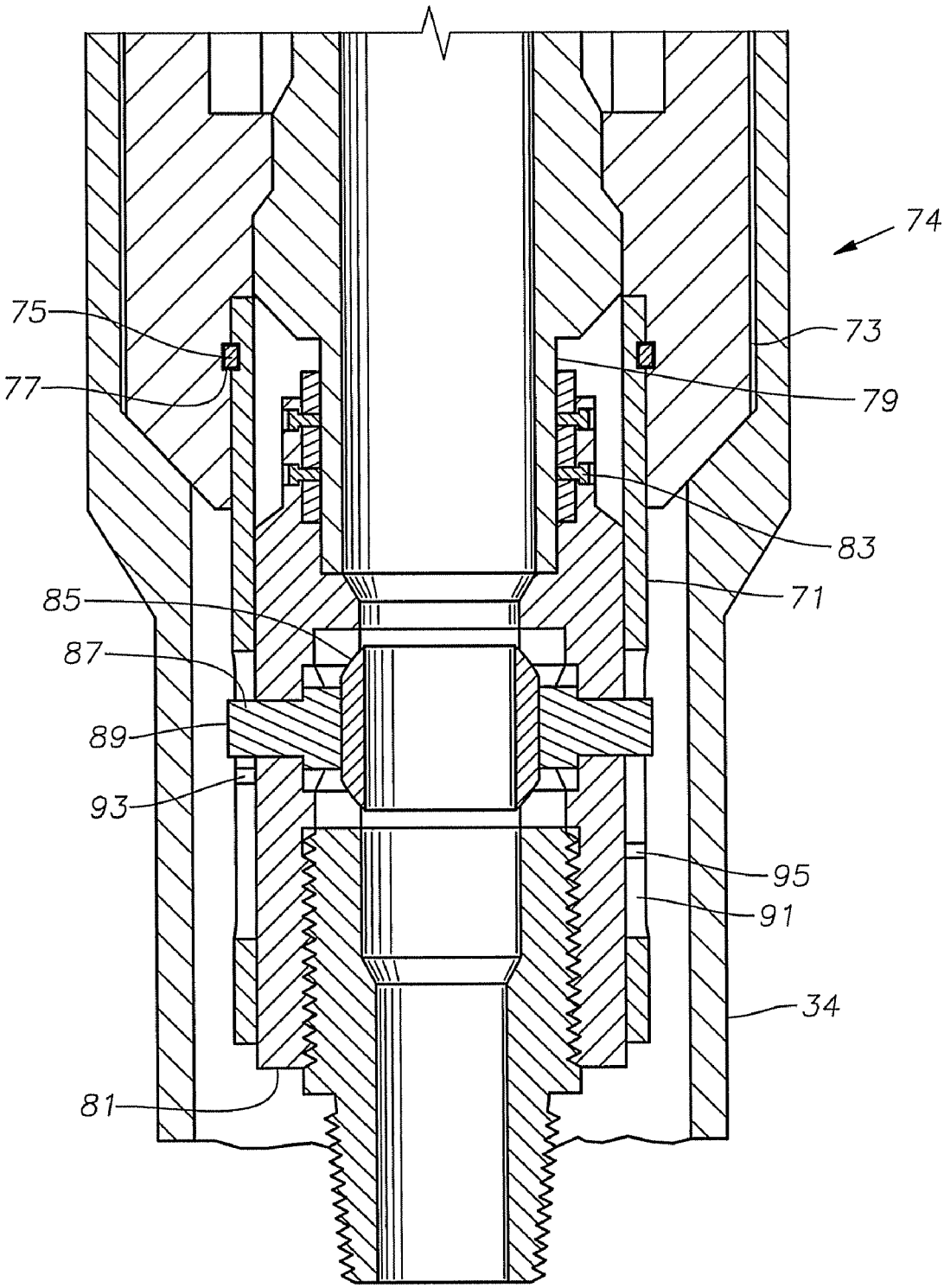
FIG. 6 is an enlarged sectional view of a running tool with a valve assembly constructed in according with an alternate embodiment of the present technique.
Figure 7:
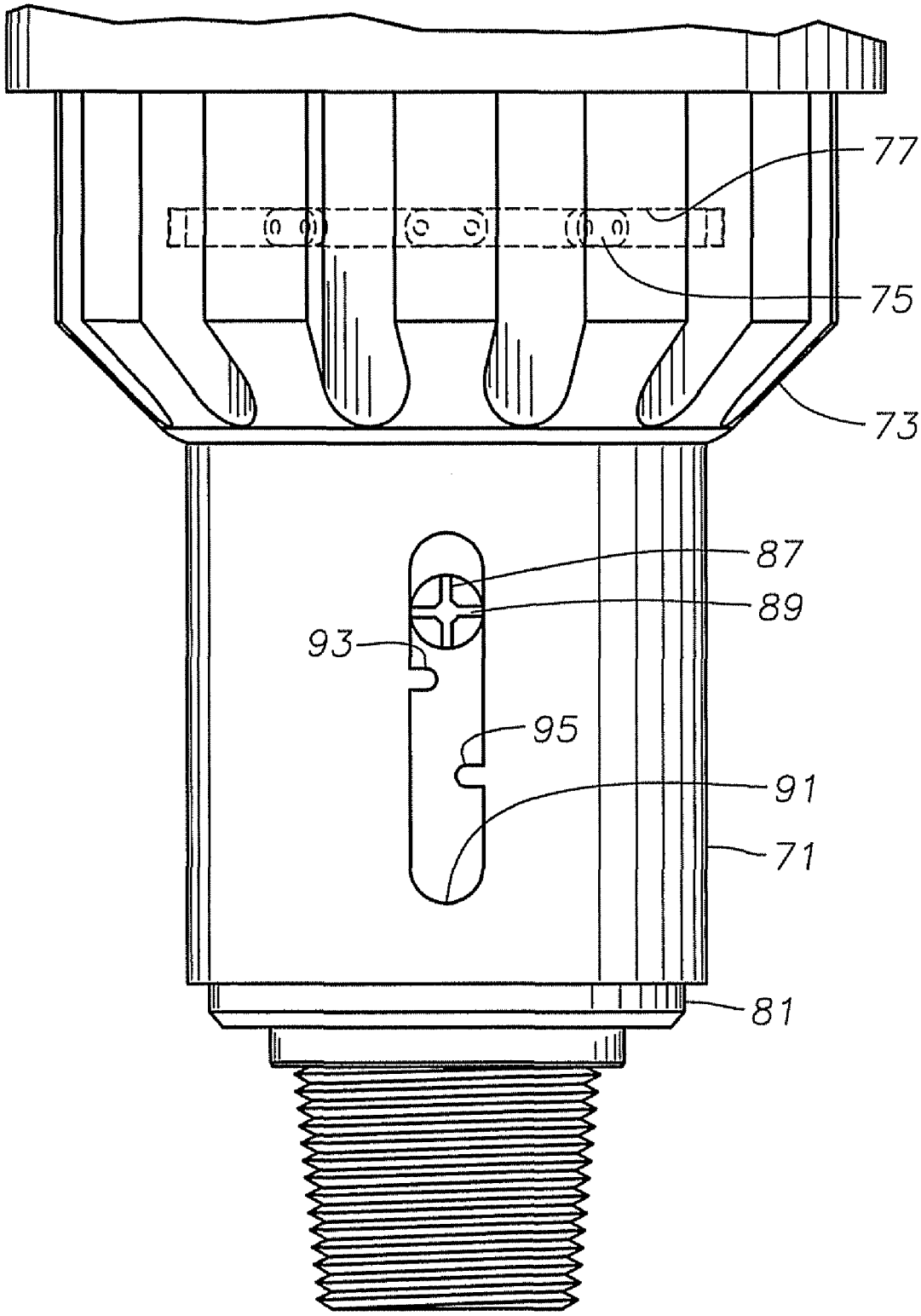
FIG. 7 is an isolated side view similar to FIG. 4, but showing an alternate embodiment valve assembly.
Figure 8:
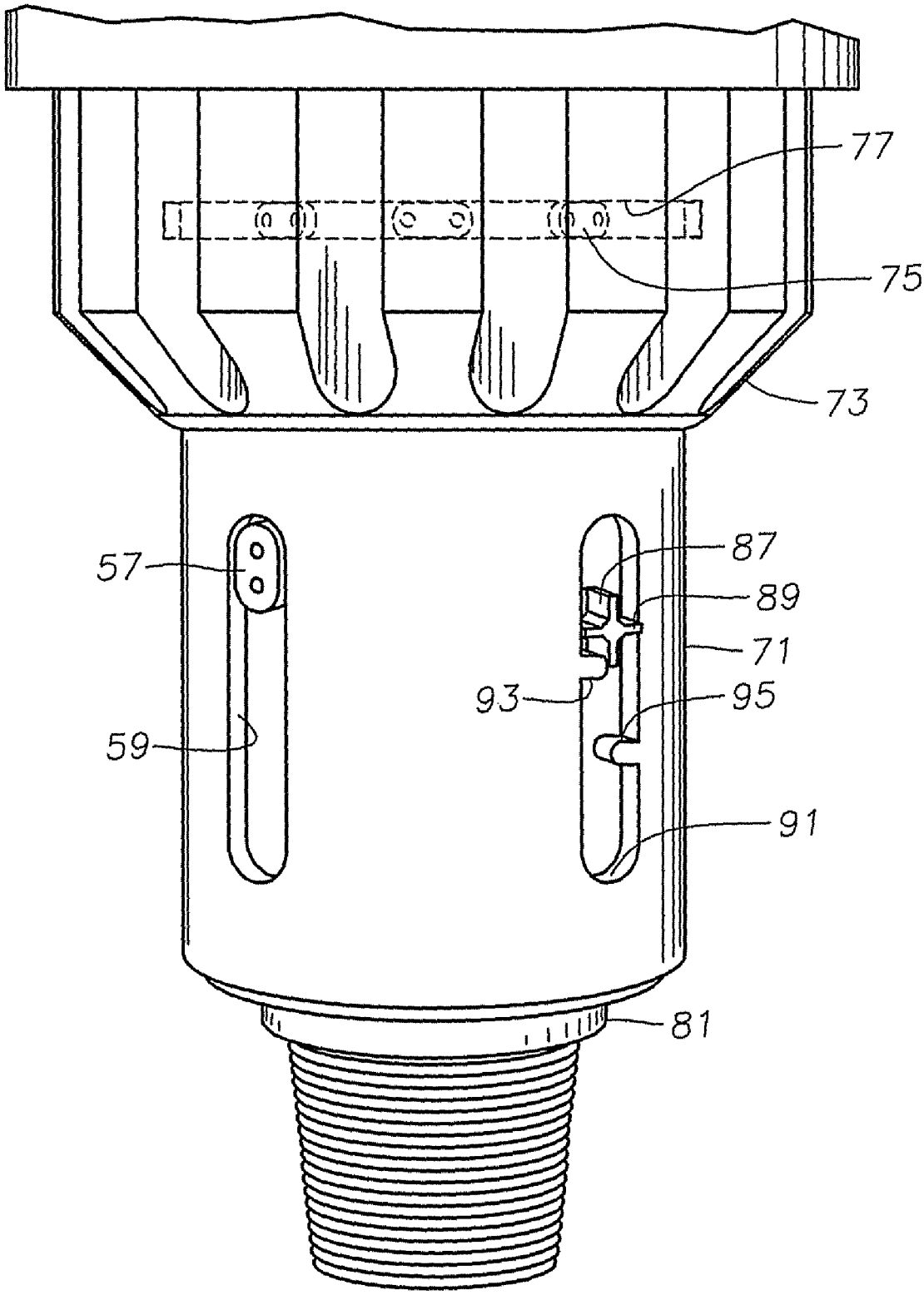
FIG. 8 is a perspective view of the running tool of FIG. 6.

Referring to FIGS. 6, 7, and 8, in an alternate embodiment of the present technique, an actuating cam 71 is connected to a body 73 of a running tool 74. The actuating cam 71 is free to rotate about the body 73, as it is connected to the body 73 by pins or keys 75 captured in a slot 77 that extends around the outer periphery of the inner surface of the body 73. The actuating cam 71 is restricted from axial movement relative to the body 73, but can rotate relative to the body 73. The running tool stem 79 is connected to a valve body 81 by anti-rotation keys 83 identical to those previously discussed in the first embodiment of the technique. In this particular embodiment, the stem 79 of the running tool rotates and also moves longitudinally relative to the body 73 to actuate an engagement element, align ports, and open and close a valve element 85 for setting and testing a packoff seal. As a result, as the stem 79 rotates, valve body 81, and actuating cam 71 rotate in unison. As stem 79 rotates, the stem 79 and the valve body 81 also move longitudinally downward relative to actuating cam 71. This alternate embodiment operates similar to the first embodiment of the technique, except in this embodiment, the tool stem 79 and the valve body 81 move axially downward relative to the body 73 as the stem 79 rotates, while the actuating cam 71 rotates with them but does not translate axially.

In operation, the cam portions 87 of actuators 89 are captured within slots 91 located in and extending through opposite sides of actuating cam 71. In this embodiment, the cam portions 87 of actuators 89 are initially in an upper position within slots 91. In order to actuate the valve element 85, the stem 79 is rotated relative to the body 73. As the stem 79 rotates relative to the body 73, the tool stem 79 and valve body 81 rotate and move axially downward relative to body 73. Actuating cam 71 rotates with stem 79 and valve body 81 but does not move downward relative to body 73. As a result, the location of the cam portions 87 of actuators 89 move downward within slots 91 in relation to the axial movement of stem 79. The stem 79 continues to rotate a specified number of revolutions, and the valve body 81 continues to simultaneously rotate and move axially downward until tabs 93 make contact with the cam portions 87 of actuators 89, causing actuators 89 to rotate clockwise as valve body 81 continues downward. As actuators 89 rotate, the valve element 85 rotates, thereby closing the valve 85. Continued rotation of the stem 79 will result in valve body 81 moving further axially downward relative to body 73 and actuating cam 71 until tabs 95 make contact with cam portions 87 of actuators 89, causing actuators 89 to rotate counter-clockwise. As actuators 89 rotate, valve element 85 also rotates, thereby closing valve element 85.

The remotely operated drill pipe valve is an effective and efficient technique to create a remotely operated seal in a section of drill pipe. The technique has significant advantages. An example of these advantages include efficiency as it saves time that would be spent waiting on a dart or other object to reach a landing sub or waiting on retrieval of a dart or other object, particularly in deep water. Another example is that the technique can be employed in deviated holes where gravity cannot feed a ball or dart along the entire length of drill pipe. Additionally, it is impossible for the valve to be open or closed at the wrong times or positions because the valve is timed with the tool, therefore, preventing damaging the running tool or other equipment.

While the invention has been shown in only one of its forms, it should be apparent to those skilled in the art that it is not so limited but is susceptible to various changes without departing from the scope of the invention. For example, although the remotely operated drill pipe valve in this embodiment has been illustrated with a two-port running tool, the remotely operated drill pipe valve can be employed with various running tool designs, such as a single port or no port running tool.

The invention claimed is:

1. An apparatus for performing remote operations in a well, comprising:

a running tool having a stem for connecting to a string of conduit, a body, and wherein remote operations of the running tool are selected in response to rotation of the stem relative to the body;

a valve connected to the running tool and having an actuator capable of moving the valve between an open position and a closed position; and an actuating cam, connected to the running tool and in engagement with the valve, the rotation of the stem on an axis of the stem relative to the body causing the actuating cam to rotate the actuator on an axis of the actuator between the open position and the closed position, thereby opening and closing the valve, the axis of the stem and the axis of the actuator being orthogonal.

2. The apparatus according to claim 1, wherein the running tool further comprises:

a passage extending through the stem along an axis of the stem;

an inner cam positioned between the stem and the body and connected to the stem and the body such that rotation of the stem causes the inner cam to translate axially relative to the body to the functional positions;

an engagement element, carried by the body and adapted to be engaged with a well pipe hanger, the axial movement of the inner cam relative to the body causing the engagement element to move radially outward and into engagement with the hanger to releasably secure the running tool to the hanger; and a piston, substantially surrounding portions of the stem, inner cam, and the body and downwardly moveable relative to the stem in response to fluid pressure applied to the axial passage to thereby set a packoff seal.

3. The apparatus according to claim 1, wherein:

the actuating cam is connected to the body and the valve is connected to the stem such that rotation of the stem relative to the body causes the valve and the actuating cam to rotate, and the actuating cam and the valve to move axially relative to each other.

4. The apparatus according to claim 3, wherein the actuating cam further comprises:

a sleeve surrounding at least a portion of the valve, the sleeve having at least one axially elongated slot located in and extending therethrough, the slot having tabs positioned along the peripheries of the slot; and wherein the actuator further comprises a member extending radially outward from the valve, the member extending through the at least one slot such that axial movement of the actuating cam and the valve relative to each other causes the member and the tabs to contact each other and move the member between an open position and a closed position.

5. The apparatus according to claim 1, wherein:

the actuating cam is connected to the body and the valve is connected to the stem such that rotation of the stem relative to the body causes the valve and the actuating cam to rotate, and the actuating cam moves axially downward relative to the body, the stem, and the valve.

6. The apparatus according to claim 1, wherein:

the actuating cam is connected to the body such that it is free to rotate relative to the body but is restricted from axial movement relative to the body, and the valve is connected to the stem such that rotation of the stem relative to the body causes the valve and the stem to rotate and the stem and the valve to simultaneously move longitudinally downward relative to the body and the actuating cam.

7. The apparatus according to claim 6, wherein the actuating cam further comprises:

a sleeve with at least one slot located in and extending therethrough, the slot having tabs positioned along the peripheries of the slot; and wherein the actuator further comprises a member extending radially outward from the valve, the member extending through the at least one slot such that rotation of the stem causes simultaneous axial movement of the stem, the valve, and the member, thereby causing the member to move within the at least one slot such that the tabs contact and move the member between an open position and a closed position downward relative to the body and the actuating cam.

8. The apparatus according to claim 1, wherein the running tool further comprises:

an inner cam positioned between the stem and the body and connected to the stem and the body such that rotation of the stem causes the inner cam to translate axially relative to the body to the functional positions and simultaneously causes the actuating cam and the valve to translate axially relative to each other.

9. The apparatus according to claim 1, wherein the running tool further comprises:

an inner cam positioned between the stem and the body and connected to the stem and the body such that rotation of the stem causes the inner cam to translate axially relative to the body to the functional positions and simultaneously causes the inner cam and actuating cam to move axially in opposite directions from each other.

10. An apparatus for performing remote operations in a well, comprising:

a running tool having a stem for connecting to a string of conduit, the stem having a passage extending therethrough along an axis of the stem, a body, and wherein remote operations of the running tool are selected in response to rotation of the stem relative to the body;

a ball valve connected to the stem and capable of moving between an open position and a closed position, the ball valve having trunnions extending radially outward therefrom;

a cam sleeve substantially surrounding the ball valve and connected to the body, the cam sleeve having axially elongated slots located in and extending therethrough, the slots each having tabs positioned along the peripheries of the slot, the trunnions extending through the slots such that axial movement of the cam sleeve and the valve relative to each other causes the trunnions and the tabs to contact each other and move the ball valve between an open position and a closed position; and wherein the stem, the ball valve, and the cam sleeve rotate in unison, and the valve and the cam sleeve simultaneously move axially relative to one another.

11. The apparatus according to claim 10, wherein:

the cam sleeve is threaded to the body and moves axially downward relative to the stem and the valve when the stem is rotated relative to the body.

12. The apparatus according to claim 10, wherein:

the cam sleeve is rotatable relative to the body but restrained against axial movement; and the stem and the valve move axially downward relative to the cam sleeve when the stem is rotated relative to the body.

13. The apparatus according to claim 10, wherein the running tool further comprises:

an inner sleeve positioned between the stem and the body and connected to the stem and the body such that rotation of the stem causes the inner sleeve to translate axially relative to the body;

a piston, substantially surrounding portions of the stem, inner sleeve, and the body and downwardly moveable relative to the stem in response to fluid pressure applied to the axial passage to thereby set a packoff seal;

ports in the stem and the inner sleeve that align with the axial passage to allow fluid pressure to be applied through the axial passage to thereby move the piston downward relative to the stem and set a packoff seal; and wherein rotation of the stem relative to the body causes the valve to move to the closed position, thereby closing the axial passage.

14. The apparatus according to claim 13, wherein:

continued rotation of the stem relative to the body in the same direction causes the valve to move to the open position, thereby opening the axial passage.

15. A method of performing a remote operation in a well, the method comprising:

(a) providing a running tool with an elongated stem, a valve connected to the stem, and having an actuator and an actuating cam, the actuating cam in cooperative engagement with the actuator;

(b) connecting the stem to a string of conduit and running the tool into a subsea wellhead in a run-in position; then (c) rotating the conduit and the stem relative to the body, causing the valve, the valve actuator, and the actuating cam to rotate in unison and moving the valve to a closed valve position; and (d) again rotating the conduit and the stem relative to the body in the same direction as in step (c), causing the valve, the valve actuator, and the actuating cam to rotate in unison and move the valve to an open valve position.

16. The method of claim 15, wherein the actuating cam moves axially relative to the valve and the valve actuator in steps (c) and (d).

17. The method of claim 15, wherein the stem, valve, and actuator move axially relative to the body and the actuating cam in steps (c) and (d).

18. The method of claim 15, wherein:

step (a) further comprises providing the running tool with a piston substantially surrounding portions of the stem and the body and downwardly moveable relative to the stem;

prior to step (b), rotating the stem relative to the body to the run-in position, thereby securely engaging the running tool with a well pipe hanger; and step (c) further comprises moving the piston downward relative to the stem to set a packoff.

19. The method of claim 15, wherein:

step (a) further comprises providing the running tool with a passage extending through the stem along an axis of the stem and ports located in and extending radially through the stem and connecting to the axial passage; an inner sleeve positioned between the stem and the body, the inner sleeve having ports extending radially therethrough and adapted to align with the stem ports; and a piston substantially surrounding portions of the stem and the body, the piston downwardly moveable relative to the stem in response to fluid pressure applied to the axial passage to thereby set a packoff seal;

prior to step (b), rotating the stem relative to the body in the same direction as in step (c) to the run-in position, thereby securely engaging the running tool with a well pipe hanger; and step (c) further comprises aligning the stem ports with the inner cam sleeves and applying fluid pressure applied to the axial passage to thereby move the piston downward relative to the stem to set the packoff.

20. The method of claim 19, wherein step (d) further comprises releasing the body from the well pipe hanger.

* * * * *